US007089180B2

(12) United States Patent
Heikkinen

(10) Patent No.: US 7,089,180 B2
(45) Date of Patent: Aug. 8, 2006

(54) METHOD AND DEVICE FOR CODING SPEECH IN ANALYSIS-BY-SYNTHESIS SPEECH CODERS

(75) Inventor: Ari P. Heikkinen, Tampere (FI)

(73) Assignee: Nokia Corporation, Espoo (FI)

( * ) Notice: Subject to any disclaimer, the term of this patent is extended or adjusted under 35 U.S.C. 154(b) by 600 days.

(21) Appl. No.: 10/167,287

(22) Filed: Jun. 10, 2002

(65) Prior Publication Data

US 2003/0055633 A1 Mar. 20, 2003

(30) Foreign Application Priority Data

Jun. 21, 2001 (FI) ..... 20011329

(51) Int. Cl.
*G10L 19/04* (2006.01)

(52) U.S. Cl. ..... 704/220; 704/223

(58) Field of Classification Search ..... 704/220, 704/223

See application file for complete search history.

(56) References Cited

U.S. PATENT DOCUMENTS 4,868,867 A * 9/1989 Davidson et al. ..... 704/200.1
5,187,745 A * 2/1993 Yip et al. ..... 704/219
5,778,334 A * 7/1998 Ozawa et al. ..... 704/219
5,809,459 A * 9/1998 Bergstrom et al. ..... 704/223
5,890,108 A * 3/1999 Yeldener ..... 704/208
5,970,444 A * 10/1999 Hayashi et al. ..... 704/223
6,233,550 B1 * 5/2001 Gersho et al. ..... 704/208
6,408,268 B1 * 6/2002 Tasaki ..... 704/220
6,493,664 B1 * 12/2002 Udaya Bhaskar et al. .. 704/222
6,526,376 B1 * 2/2003 Villette et al. ..... 704/207
6,556,966 B1 * 4/2003 Gao ..... 704/220

OTHER PUBLICATIONS

Granzow et al, "High-Quality Dgital Speech at 4kb/s", Global Telecommunications Conference, 1990, GLOBECOM '90; Dec. 2-5, 1990, pp. 941-945.*
Ojala, "Toll Quality Variable-Rate Speech Codec", ICASSP 1997, vol. 2 Apr. 21-24, 1997, pp. 747-750, vol. 2.*
Park et al, "On a Time Reduction of Pitch Searching by the Regular Pulse Technique in the CELP Vocoder", vol. 1, Nov. 2-5, 1997, pp. 512-516, vol. 1.*
Paksoy et al, "A Variable-Rate Multimodal Speech Coder with Gain-Matched Analysis-by-Synthesis", ICASSP 1997, pp. 751-754, vol. 2.*

(Continued)

*Primary Examiner*—Richemond Dorvil
*Assistant Examiner*—Michael N. Opsasnick
(74) *Attorney, Agent, or Firm*—Harrington & Smith, LLP

(57) ABSTRACT

The present invention discloses a method of improving the coded speech quality in low bit rate analysis-by-synthesis (AbS) speech coders. This is accomplished by relaxing the waveform matching constraints for non-stationary plosive speech segments of speech signals by suitably shifting pulse locations of the coded excitation signal. The shifting results in the coded signal having phase information that does not exactly match original signal in places where it is perceptually insignificant to the listener. Furthermore, a technique for adaptive phase dispersion is introduced to the coded excitation signal to efficiently preserve important signal characteristics such as the energy spread of the original signal.

23 Claims, 6 Drawing Sheets

OTHER PUBLICATIONS

Hagen et al, "Removal of Sparse-Excitation Artifacts in CELP," International Conference on Acoustics, Speech, and Signal Processing, Seattle, May 1998, pp. 145-148.*

TIA/EIA IS-641-A, TDMA Cellular/PCS—Radio Interface, Enhanced Full-Rate Voice Codec, Revision A.

"Removal of sparse-excitation artifacts in CELP," by R. Hagen, E. Ekudden and B. Johansson and W. B. Kleijn, Proceedings of *IEEE International Conference on Acoustics, Speech, and Signal Processing*, Seattle, May 1998.

* cited by examiner

METHOD AND DEVICE FOR CODING SPEECH IN ANALYSIS-BY-SYNTHESIS SPEECH CODERS

FIELD OF THE INVENTION

The present invention relates generally to coding of speech and audio signals and, more specifically, to an improved excitation modeling procedure in analysis-by-synthesis coders.

BACKGROUND OF THE INVENTION

Speech and audio coding algorithms have a wide variety of applications in wireless communication, multimedia and voice storage systems. The development of the coding algorithms is driven by the need to save transmission and storage capacity while maintaining the quality of the synthesized signal at a high level. These requirements are often quite contradictory, and thus a compromise between capacity and quality must typically be made. The use of speech coding is particularly important in mobile telecommunication systems since the transmission of the full speech spectrum would require significant bandwidth in an environment where spectral resources are relatively limited. Therefore the use of signal compression techniques are employed through the use of speech encoding and decoding, which is essential for efficient speech transmission at low bit rates.

FIG. 1 shows an exemplary procedure for the transmission and/or storage of digital audio signals for subsequent reproduction at the output end. A speech signal y(k) is input into encoder 100 to encode the signal into a coded digital representation of the original signal. The resulting bit stream is sent to a communication channel (e.g. a radio channel) or storage medium 110 such as a solid state memory, a magnetic or optical storage medium, for example. From the channel/storage medium 110, the bit stream is input into a decoder 120 where it is decoded in order to reproduce the original signal y(k) in the form of output signal $\hat{y}(k)$.

Speech coding algorithms and systems can be categorized in different ways depending on the criterion used. One way of classifying them consists of waveform coders, parametric coders, and hybrid coders. Waveform coders, as the name implies, try to preserve the waveform being coded as closely as possible without paying much attention to the characteristics of the speech signal. Waveform coders also have the advantage of being relatively less complex and typically perform well in noisy environments. However, they generally require relatively higher bit rates to produce high quality speech. Hybrid coders use a combination of waveform and parametric techniques in that they typically use parametric approaches to model, e.g., the vocal tract by an LPC filter. The input signal for the filter is then coded by using what could be classified as waveform coding method. Currently, hybrid speech coders are widely used to produce near wireline speech quality at bit rates in the range of 8–12 kbps.

In many current hybrid coders, the transmitted parameters are determined in an Analysis-by-Synthesis (AbS) fashion where the selected distortion criterion is minimized between the original speech signal and the reconstructed speech corresponding to each possible parameter value. These coders are thus often called AbS speech coders. By way of example, in a typical AbS coder, an excitation candidate is taken from a codebook, filtered through the LPC filter, in which the error between the filtered and input signal is calculated such that the one providing the smallest error is chosen.

In a typical AbS speech coder, the input speech signal is processed in frames. Usually the frame length is 10–30 ms, and a look-ahead segment of 5–15 ms of the subsequent frame is also available. In every frame, a parametric representation of the speech signal is determined by an encoder. The parameters are quantized, and transmitted through a communication channel or stored in a storage medium in digital form. At the receiving end, a decoder constructs a synthesized speech signal representative of the original signal based on the received parameters.

One important class of analysis-by-synthesis speech coder is the Code Excited Linear Predictive (CELP) speech coder which is widely used in many wireless digital communication systems. CELP is an efficient closed loop analysis-by-synthesis coding method that has proven to work well for low bit rate systems in the range of 4–16 kbps. In CELP coders, speech is segmented into frames (e.g. 10–30 ms) such that an optimum set of linear prediction and pitch filter parameters are determined and quantized for each frame. Each speech frame is further divided into a number of subframes (e.g. 5 ms) where, for each subframe, an excitation codebook is searched to find an input vector to the quantized predictor system that gives the best reproduction of the original speech signal.

The basic underlying structure of most AbS coders is quite similar. Typically they employ a type of linear predictive coding (LPC) technique, for example, a cascade of time variant pitch predictor and an LPC filter. An all-pole LPC filter:

$$\frac{1}{A(q,s)} = \frac{1}{1 + a_1(s)q^{-1} + a_2(s)q^{-2} + \ldots + a_{n_a}(s)q^{-n_a}}, \tag{1}$$

where $q^{-1}$ is unit delay operator and s is subframe index, is used to model the short-time spectral envelope of the speech signal. The order $n_a$ of the LPC filter is typically 8–12.

A pitch predictor of the form:

$$\frac{1}{B(q,s)} = \frac{1}{1 - b(s)q^{-\tau(s)}} \tag{2}$$

utilizes the pitch periodicity of speech to model the fine structure of the spectrum. Typically, the gain b(s) is bounded to the interval [0, 1.2], and the pitch lag $\tau(s)$ to the interval [20, 140] samples (assuming a sampling frequency of 8000 Hz). The pitch predictor is also referred to as long-term predictor (LTP) filter.

FIG. 2 shows a simplified functional block diagram of an exemplary AbS speech encoder. An excitation signal $u_c(k)$ is produced by an excitation generator 200. The excitation generator 200 is often referred to as an excitation codebook, where the signal is multiplied by a gain g(s) 205 to form an input signal to a filter cascade 225. A feedback loop consisting of the delay $q^{-\tau}(S)$ 215 and the gain b(s) 210 represent an LTP filter. The LTP filter models the periodicity of the signal, which is especially relevant in voiced speech, where the prior periodic speech is used as an approximate for the speech in current subframe and the error is coded using fixed excitation such as an algebraic codebook. The output of the filter cascade 225 is a synthesized speech signal $\hat{y}(k)$. In the encoder, an error signal e(k) (mean squared weighted error) is computed by subtracting the synthesized speech signal $\hat{y}(k)$ from the original speech signal y(k). An error minimizing procedure 235 is employed to choose the best excitation signal provided for by the excitation generator 200. Typically, a perceptual weighting filter is applied to the error signal prior to the error minimization procedure in order to shape the spectrum of the error signal so that it is less audible.

Although AbS speech coders generally provide good performance at low bit rates they are relatively computationally demanding. Another characteristic is that at low bit rates, e.g. below 4 kbps, the matching to the original speech waveform becomes a severe constraint in improving the coding efficiency further. This applies to the coding of speech in general which includes voiced, unvoiced, and plosive speech. Although there have been solutions put forth for improvements in modeling voiced speech, substantial improvements in modeling nonstationary speech such as plosives have so far not been presented. As known by those skilled in the art, plosives and unvoiced speech tend to be abrupt such as in the stop consonants like /p/, /k/, and /t/, for example. These speech waveforms are particularly difficult to model accurately in prior-art low bit rate AbS coders since there is often a clear mismatch between the original and coded excitation signals due to the lack of bits to accurately model the original excitation. The differences in the overall waveform shape causes the energy of the coded excitation to be much smaller than that of the ideal excitation due to the parameter estimation method. This often results in synthesized speech that can sound unnatural at a very low energy level.

FIG. 3 illustrates the resulting synthetic excitation of a CELP coder when using a codebook having a relatively high pulse population density (codebook 1) i.e. a dense pulse position grid. Also shown is the resulting synthetic excitation when using a codebook having a relatively lower pulse population density (codebook 2). In top graph A, the ideal excitation for the sound /p/ is shown. In both codebooks, two positive or negative pulses are used over a subframe of 40 samples. The example pulse locations and shifts for the individual codebooks are presented separately in Table 1 and Table 2 respectively. As can be seen by the bottom graph C, the excitation signal constructed by using the codebook of Table 2 has a much lower energy level than the ideal excitation (top) since the possible pulse locations do not match well with pulse locations in the ideal excitation. In contrast, when codebook 1 is used, the energy is significantly higher because the pulse locations more closely match the ideal excitation, as shown in the middle graph B. For both codebooks, only one pulse gain is used per subframe and adaptive codebooks are not used.

TABLE 1

| Pulse | Positions |
|---|---|
| 0 | 0, 2, 4, 6, 8, 10, 12, 14, 16, 18, 20, 22, 24, 26, 28, 30, 32, 34, 36, 38 |
| 1 | 1, 3, 5, 7, 9, 11, 13, 15, 17, 19, 21, 23, 25, 27, 29, 31, 33, 35, 37, 39 |

TABLE 2

| Pulse | Positions |
|---|---|
| 0 | 0, 4, 8, 12, 16, 20, 24, 28, 32, 36 |
| 1 | 2, 6, 10, 14, 18, 22, 26, 30, 34, 38 |

The resulting energy disparity between the synthesized excitations is clearly evident when using a codebook having fewer pulse positions whereby the lower energy excitation results in a sound that is unsatisfactory and barely audible. In view of the foregoing, an improved method is needed which enable AbS speech coders to more accurately produce high quality speech in speech signals containing nonstationary speech.

SUMMARY OF THE INVENTION

Briefly described and in accordance with an embodiment and related features of the invention, in a method aspect of the invention there is provided a method of encoding a speech signal wherein the speech signal is encoded in an encoder using a first excitation codebook having a first position grid and a second excitation codebook having a second position grid to produce a coded excitation signal, wherein the first position grid contains a higher population density of pulse positions than the second position grid.

In a further method aspect, there is provided a method of transmitting a speech signal from a sender to a receiver comprising the steps of:

encoding a speech excitation signal with an encoder at the sender;

transmitting said encoded excitation signal to the receiver; and decoding said encoded excitation signal with a decoder to produce synthesized speech at the receiver, wherein the speech excitation signal is encoded in the encoder using a first excitation codebook having a first position grid and a second excitation codebook having a second position grid to produce a coded excitation signal which is decoded in the decoder using the second excitation codebook, wherein the first position grid contains a higher population density of pulse positions than the second position grid.

In a device aspect, there is provided an encoder for encoding speech signals wherein the encoder comprises a first excitation codebook and a second excitation codebook for use in encoding said speech signals, wherein the first excitation codebook contains a higher population density of pulse positions than the second excitation codebook.

In a further device aspect, there is provided a device comprising a speech coder for encoding and decoding speech signals, wherein the device further comprises a first pulse codebook for use with the encoder and a second pulse codebook for use with the decoder, wherein the first codebook contains a higher population density of pulse positions than the second codebook.

BRIEF DESCRIPTION OF THE DRAWINGS

The invention, together with further objectives and advantages thereof, may best be understood by reference to the following description taken in conjunction with the accompanying drawings in which.

DETAILED DESCRIPTION OF THE INVENTION

As mentioned in the preceding sections, it has generally been difficult for prior art AbS speech coders to accurately model speech segments containing plosives or unvoiced speech. High quality speech can be attained by having a good understanding of the speech signal and a good knowledge of the properties of human perception. By way of example, it is known that certain types of coding distortion are imperceptible since they are masked by the signal, and taken together with exploitation of signal redundancy, improved speech quality to be attained at low bit rates.

Figure 4:
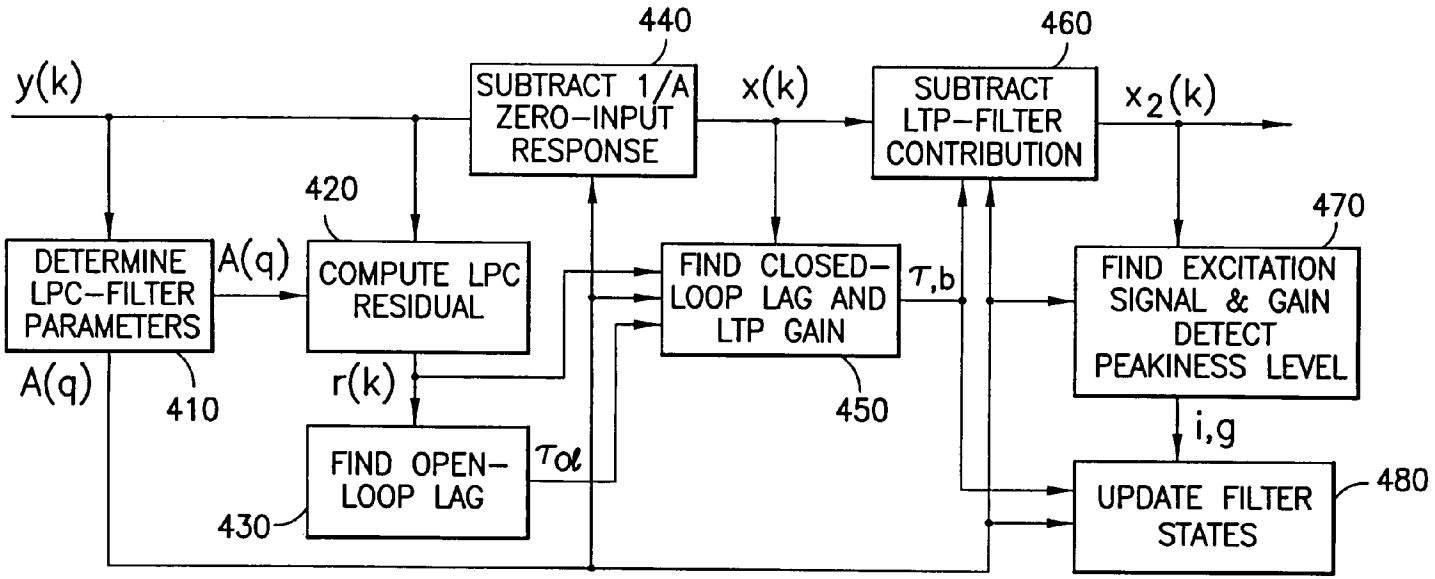
FIG. 4 shows a schematic diagram of an exemplary AbS encoding procedure.

FIG. 4 shows a schematic diagram of an exemplary AbS encoding procedure. It should be noted that not all functional component blocks may necessarily be executed in every subframe. By way of example, in a IS-641 speech coder the frame is divided into four subframes where, for example, the LPC filter parameters are determined once per frame; the open loop lag twice per frame; and the closed loop lag, LTP gain, excitation signal and its gain are determined four times per frame. A more thorough discussion of the IS-641 coder is given in TIA/EIA IS-641-A, TDMA Cellular/PCS—Radio Interface, Enhanced Full-Rate Voice Codec, Revision A.

In block 410, the coefficients of the LPC filter are determined based on the input speech signal. Typically, the speech signal is windowed into segments and the LPC filter coefficients are determined using e.g. a Levinson-Durbin algorithm. It should be noted that the term speech signal can refer to any type of signal derived from a sound signal (e.g. speech or music) which can be the speech signal itself or a digitized signal, a residual signal etc. In many coders, the LPC coefficients are typically not determined for every subframe. In such cases the coefficients can be interpolated for the intermediate subframes. In block 420, the input speech is filtered with A(q, s) to produce an LPC residual signal. The LPC residual is subsequently used to reproduce the original speech signal when fed through an LPC filter 1/A(q, s). Therefore it is sometimes referred to as ideal excitation.

In block 430, an open loop lag is determined by finding the delay value that gives the highest autocorrelation value for the speech or the LPC residual signal. In block 440, a target signal x(k) for the closed loop lag search is computed by subtracting the zero input response of the LPC filter from the speech signal. This occurs in order to take into account the effect of the initial states of the LPC filter for a smoothly evolving signal. In block 450, a closed loop lag and gain are searched by minimizing the mean sum-squared error between the target signal and the synthesized speech signal. A closed loop lag is searched around the open loop lag value. For example, an open-loop lag value is an estimate which is not searched using AbS and around which the closed-loop lag is searched. Typically, integer precision is used for open-loop lag while the fractional resolution can be used for closed-loop lag search. A detailed explanation can be found in the IS-641 specification mentioned previously, for example.

In block 460, the target signal $x_2(k)$ for the excitation search is computed by subtracting the contribution of the LTP filter from the target signal of the closed loop lag search.

The excitation signal and its gain are then searched by minimizing the sum-squared error between the target signal and the synthesized speech signal in block 470. Typically, some heuristic rules may be employed at this stage to avoid an exhaustive search of the codebook for all possible excitation signal candidates in order to reduce the search time. In block 480, the filter states in the encoder are updated to keep them consistent with the filter states in the decoder. It should be noted that the encoding procedure also includes quantization of the parameters to be transmitted where discussion of which has been omitted for reasons of simplification.

Figure 1:
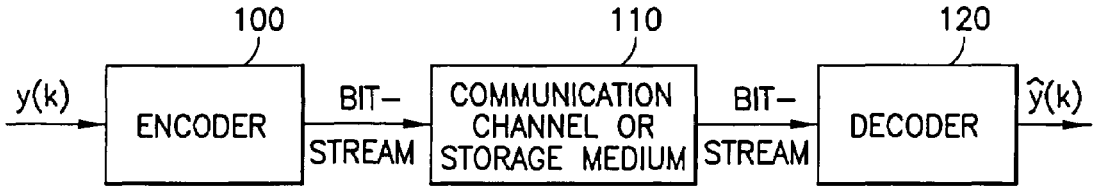
FIG. 1 shows an exemplary transmission and/or storage of digital audio signals.
Figure 2:
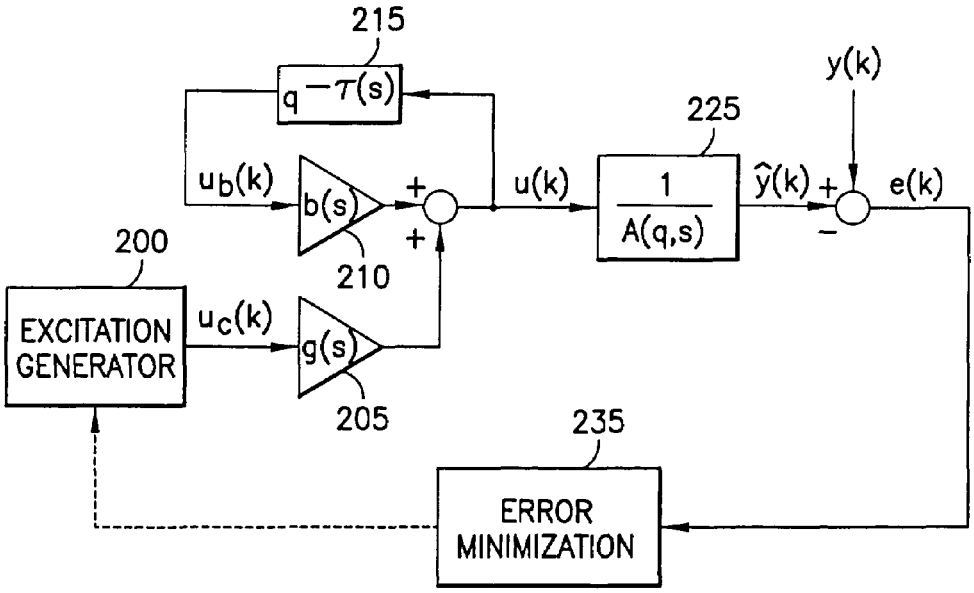
FIG. 2 shows a simplified functional block diagram of an exemplary analysis-by-synthesis (AbS) speech encoder.
Figure 3:
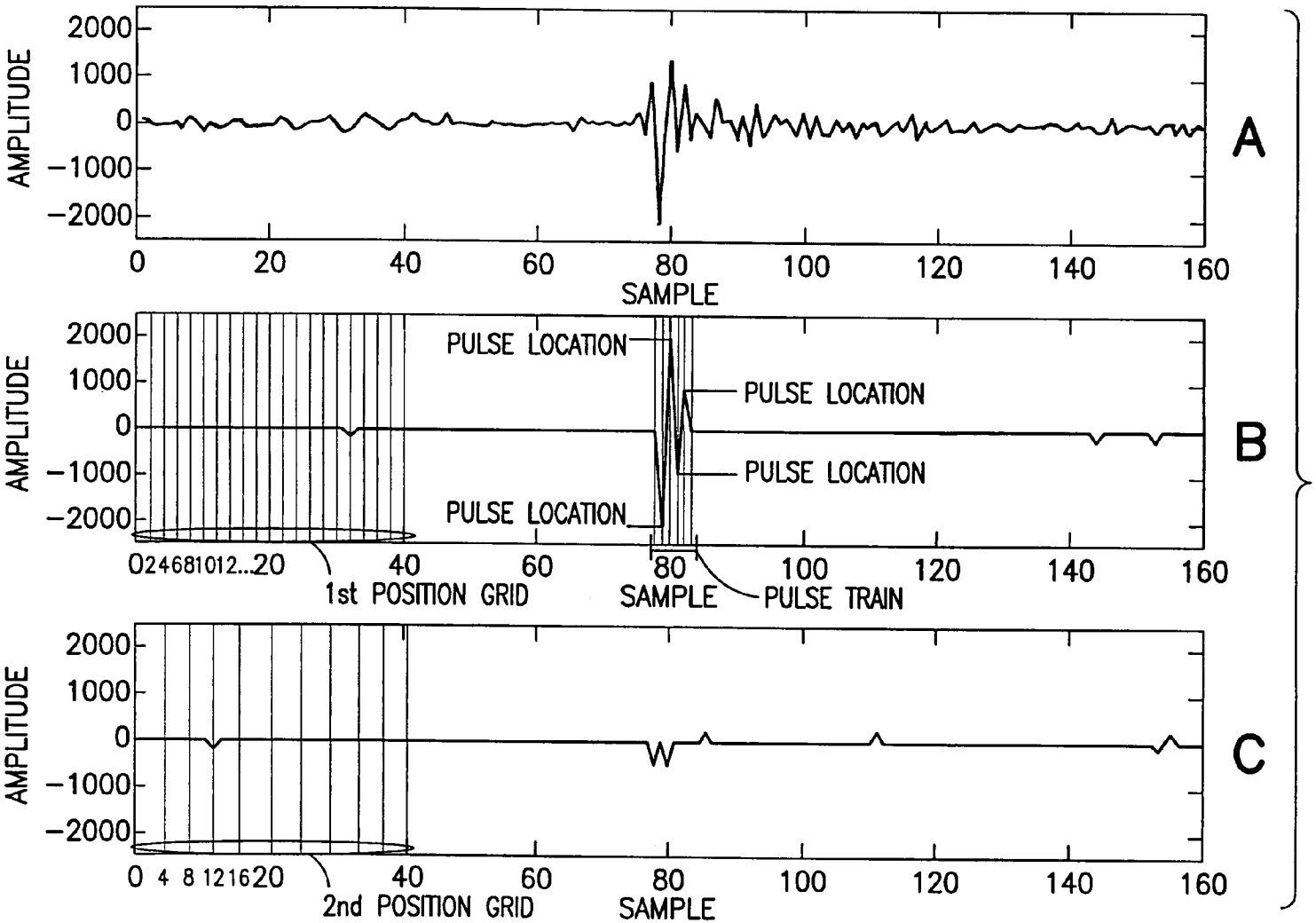
FIG. 3 shows the disparity of energy content in excitation signals generated by codebooks having different a number of pulse locations.

In prior-art, the optimal excitation sequence as well as the LTP gain and excitation sequence is searched by minimizing the sum-squared error between the target signal and the synthesized signal, $$J(g(s),u_c(s))=\|x_2(s)-\hat{x}_2(s)\|^2=\|x_2(s)-g(s)H(s)u_c(s)\|^2, \tag{3}$$

where $x_2(s)$ is a target vector consisting of the $x_2(k)$ samples over the search horizon, $\hat{x}_2(s)$ the corresponding synthesized signal, and $u_c(s)$ the excitation vector as represented in FIGS. 2 and 3. H(s) is the impulse response matrix of the LPC filter, and g(s) is the gain. Optimal gain can be found by setting the partial derivative of the cost function with respect to the gain equal to zero, $$g(s)=\frac{x_2(s)^T H(s)u_c(s)}{u_c(s)^T H(s)^T H(s)u_c(s)}. \tag{4}$$

Where we obtain by substituting (4) into (3), it is found that, $$J(u_c(s))=x_2(s)^T x_2(s)-\frac{(x_2(s)^T H(s)u_c(s))^2}{u_c(s)^T H(s)^T H(s)u_c(s)}. \tag{5}$$

The optimal excitation is usually searched by maximizing the latter term of equation (5), $x_2(s)^T H(s)$ and $H(s)^T H(s)$ can be computed prior to the excitation search.

In the present invention, a method for excitation modeling during nonstationary speech segments in analysis-by-synthesis speech coders is described. The method takes advantage of aural perception features where the insensitivity of human ear to accurate phase information in speech signals is exploited by relaxing the waveform matching constraints of the coded excitation signal. Preferably, this is applied to the nonstationary speech or unvoiced speech. Furthermore, introduction of adaptive phase dispersion to the coded excitation is used to efficiently preserve the important relevant signal characteristics.

In an embodiment of the invention, the waveform matching constraint is relaxed in the fixed codebook excitation generation. In the embodiment, two pulse position codebooks; codebook 1 and codebook 2 are used to derive the transmitted excitation together with its gain. The first pulse position codebook is used in encoder only and contains a dense position grid (or script). The second codebook is sparser and includes the transmitted pulse positions, which is thus used in both the encoder and decoder. The transmitted excitation signal with the corresponding gain value may be derived in the following way. Firstly, an optimal excitation signal with its gain is searched using codebook 1. Due to the relatively dense grid of codebook 1, the shape and energy of the ideal excitation signal are efficiently preserved. Secondly, the found pulse locations are quantized to the possible pulse locations of codebook 2 e.g. by finding the closest pulse position from codebook 2 for the ith pulse to the position for the same pulse found by using codebook 1. Thus, he quantized pulse location $Q(x_{t,1})$ of ith pulse is derived e.g. by minimizing, $$d(x_{i,1}, Q(x_{i,1})) = \min_{y_{ij,2} \in C_{i,2}} |x_{i,1} - y_{ij,2}|, \tag{6}$$

where $x_{t,1}$ is the position of the ith pulse from codebook 1 and $C_{i,2}$ contains the possible pulse positions for the ith pulse in codebook 2. The gain value obtained by using codebook 1 is transmitted to the decoder. It should be noted that the terms pulses and pulse locations are referred to herein but other types of representations (e.g. samples, waveforms, wavelets) may be used to mark the locations in the codebooks or represent the pulses in the encoded signal, for example. It should be noted that the pulses and pulse locations are referred to above but other types of representations (e.g. waveforms or wavelets) may be used to mark the locations in the codebooks or represent the pulses in the encoded signal, for example.

Figure 5:
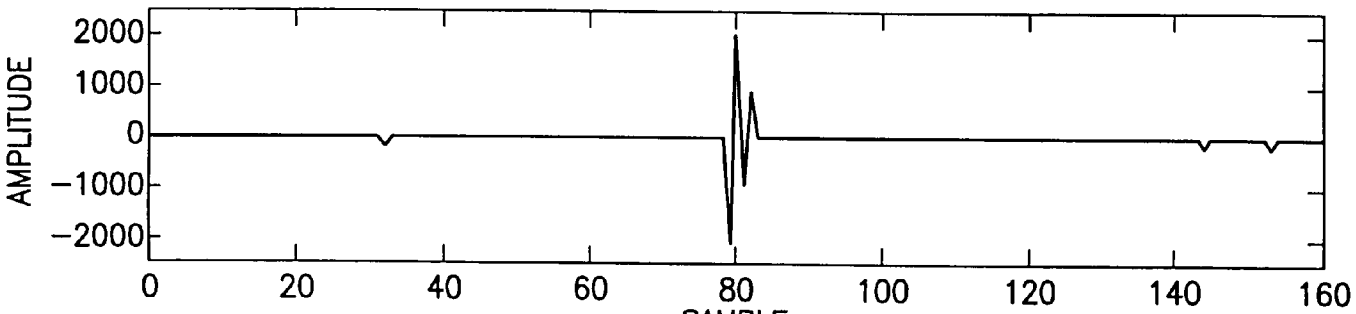
FIG. 5 shows the ideal excitation signal modeled by the embodiment of the present invention.

FIG. 5 shows the ideal excitation of FIG. 3 modeled by the embodiment of the invention using codebooks 1 and 2 from Table 1 and Table 2, respectively. As it can be seen from the figure the energy and the shape of the ideal excitation is more efficiently preserved by using the combination of codebooks 1 and 2 than by only using only one codebook, as in the prior art. In both cases the bit rate remained the same.

Another significant aspect is the energy dispersion of the coded excitation signal. To mimic the energy dispersion of the ideal excitation, an adaptive filtering mechanism is introduced to the coded excitation signal. There are a number of filtering methods that can be use with the invention. In the embodiment, a filtering method is used where the desired dispersion is achieved by randomizing the appropriate phase components of the coded excitation signal. For a more detailed discussion of the filtering mechanism, the interested reader may refer to "Removal of sparse-excitation artifacts in CELP," by R. Hagen, E. Ekudden and B. Johansson and W. B. Kleijn, Proceedings of *IEEE International Conference on Acoustics, Speech, and Signal Processing*, Seattle, May 1998.

In the filtering method, a threshold frequency is defined above which the phase components are randomized and below which they remain unchanged. The phase dispersion implemented only in the decoder to the coded signal has been observed to produce high quality. In the embodiment, an adaptation method for the threshold frequency is introduced to control the amount of dispersion. The threshold frequency is derived from the "peakiness" value of the ideal excitation signal, where the "peakiness" value defines the energy spread within the frame. The "peakiness" value P is generally defined for the ideal excitation r(n) given by, $$P = \frac{\sqrt{1/N \sum_{n=0}^{N-1} r^2(n+1)}}{1/N \sum_{n=0}^{N-1} |r(n+1)|}, \tag{7}$$

where N is the length of the frame from which the "peakiness" value is calculated, and r(n) is the ideal excitation signal.

Figure 6:
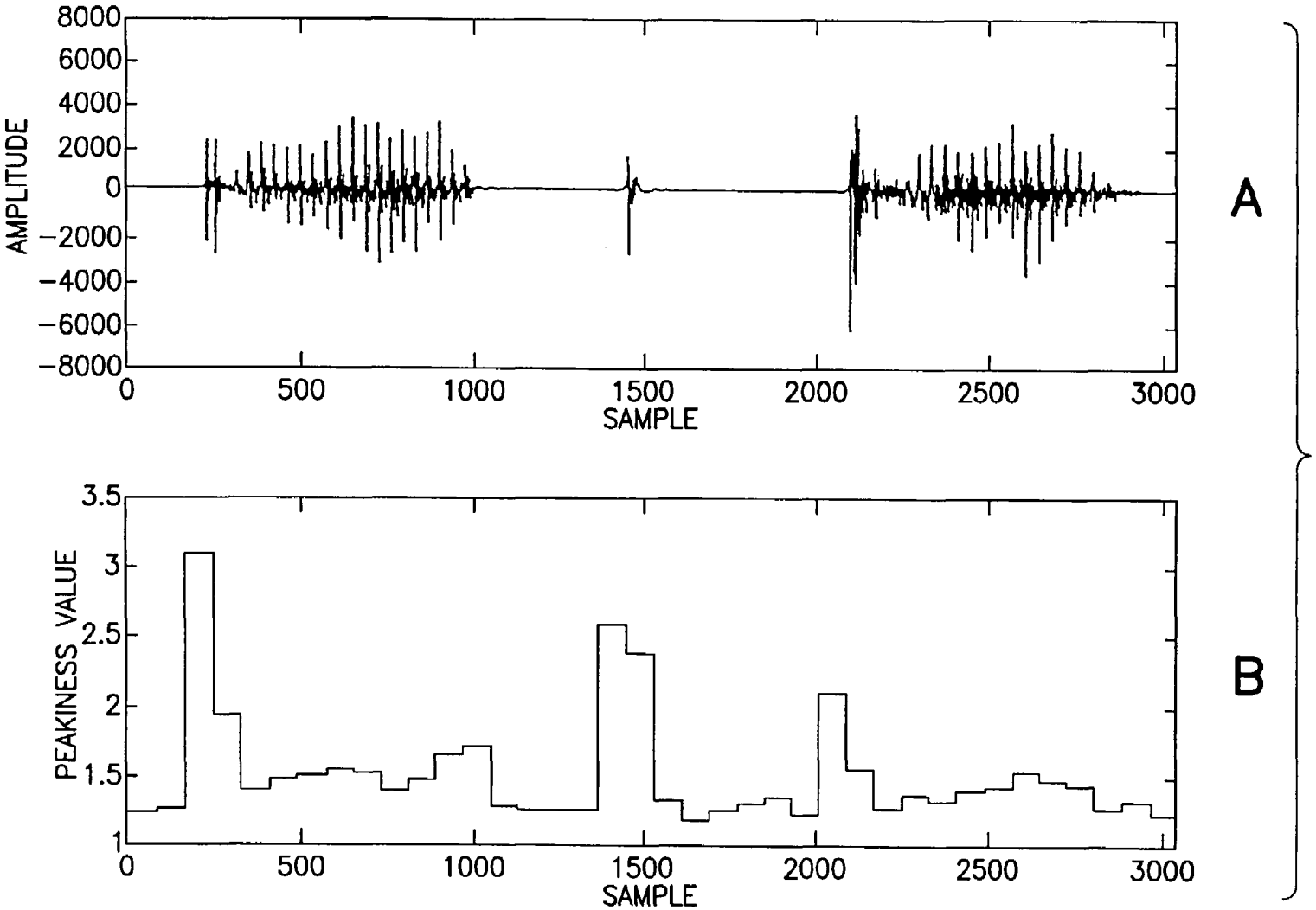
FIG. 6 illustrates an exemplary "peakiness" value contour for an exemplary ideal excitation signal.

FIG. 6 illustrates an exemplary "peakiness" value contour for an exemplary excitation signal. The top graph A depicts the ideal excitation signal where the bottom graph B depicts the corresponding "peakiness" contour with a frame size of 80 samples generated by equation (7). As can be seen, the resulting value gives a good indication of peak characteristics of the signal and correlates well with the general peak activity of the ideal excitation, since significant peak activity it is known to be indicative of plosive speech.

In the embodiment, adaptive phase dispersion is introduced to the coded excitation to better preserve the energy dispersion of the ideal excitation. The overall shape of the energy envelope of the decoded speech signal is important for natural sounding synthesized speech. Due to human perception characteristics, it is known that during plosives, for example, the accurate location of the signal peak positions or the accurate representation of the spectral envelope is not crucial for high quality speech coding.

The adaptive threshold frequency above which the phase information is randomized is defined as a function of the "peakiness" value in the invention. It should be noted that there are several ways that could be used to define this relationship. One example, but no means the only example, is a piecewise linear function that can be defined as follows, $$disp_{thr} = \begin{cases} \alpha\pi, & P < P_{low} \\ \alpha\pi + (P - P_{low})(\pi - \alpha\pi)/(P_{high} - P_{low}), & P_{low} \le P \le P_{high}, \\ \pi, & P > P_{high} \end{cases} \tag{8}$$

where $\alpha \in [0,1]$ defines the lower bound to the threshold frequency below which the dispersion is kept constant, and $P_{low}$ and $P_{high}$ define the range for the "peakiness" value beyond which the threshold frequency is kept constant.

Figure 7:
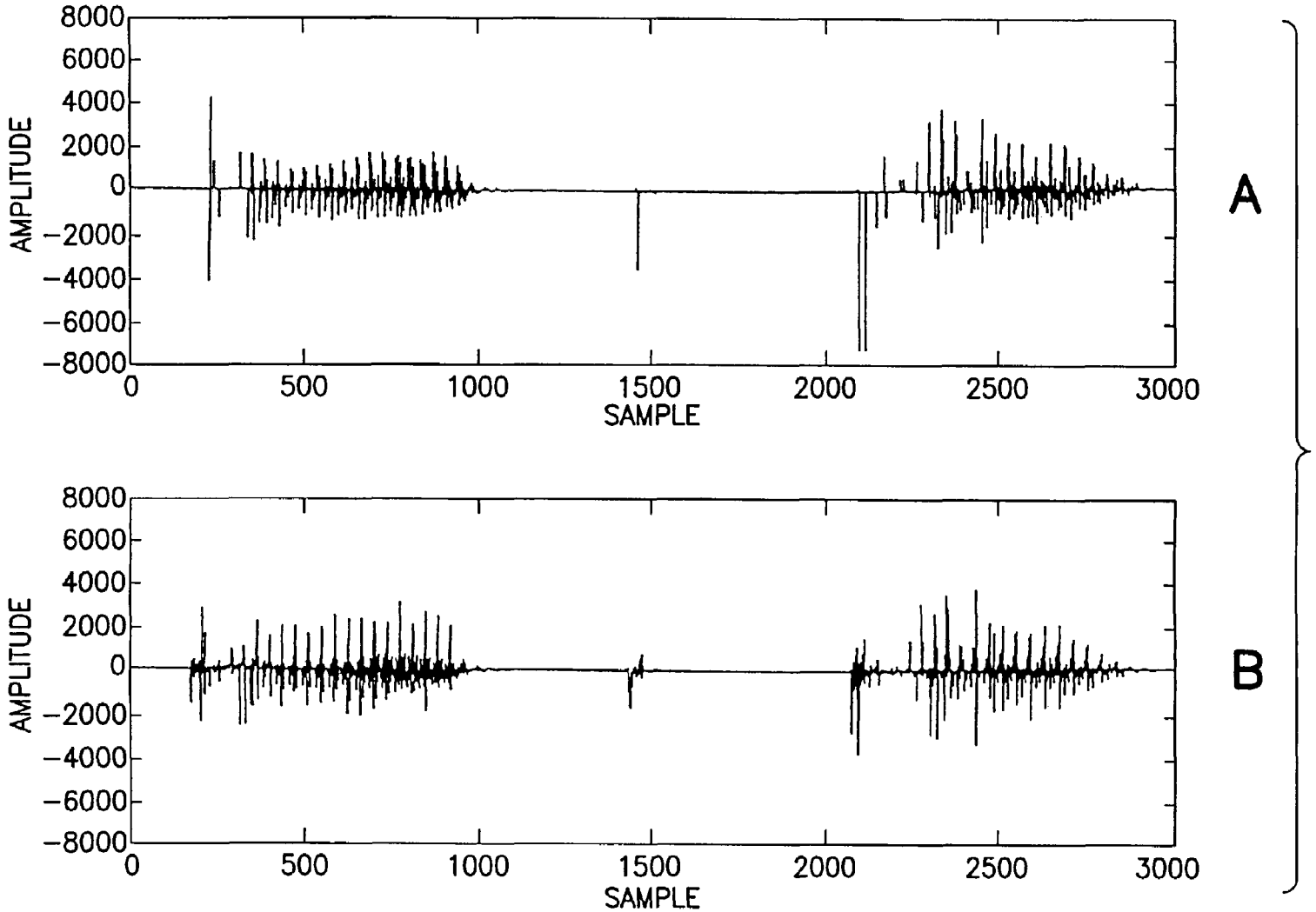
FIG. 7 shows the effect of phase dispersion filtering on a coded excitation signal.

FIG. 7 shows a diagram of the affect of phase dispersion filtering on a coded excitation signal. The ideal excitation signal of FIG. 6 is modeled by an IS-641 coder, with the exception of plosives /p/, /t/ and /k/, where the described method with two fixed codebooks is used with one gain value per 40 samples. It should be noted here that the contribution of LTP information was neglected during plosives. In the upper diagram A, the coded excitation obtained without phase dispersion is introduced. The lower diagram B depicts the phase dispersed excitation with parameter values $P_{low}$=1.5, $P_{high}$=3 and $\alpha$=0.5. To enable the use of the described phase dispersion approach, information about the threshold frequency must be sent to from the encoding side to the decoder. In the decoder, either the non-dispersed or dispersed excitation signal is used to update the required memories. The use of the inventive technique to exploit the adaptive dispersion filtering results in the naturalness of the synthesized speech which can be seen from diagram B of FIG. 7.

Figure 8:
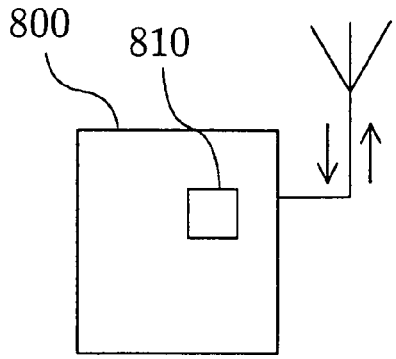
FIG. 8 illustrates an exemplary device utilizing the speech coder of the present invention.

FIG. 8 illustrates an exemplary application of the speech coder 810 of the present invention operating within a device 800 such as a mobile terminal. In addition, the device 800 could also represent a network radio base station or a voice storage or voice messaging device implementing the speech coder 810 of the invention.

Figure 9:
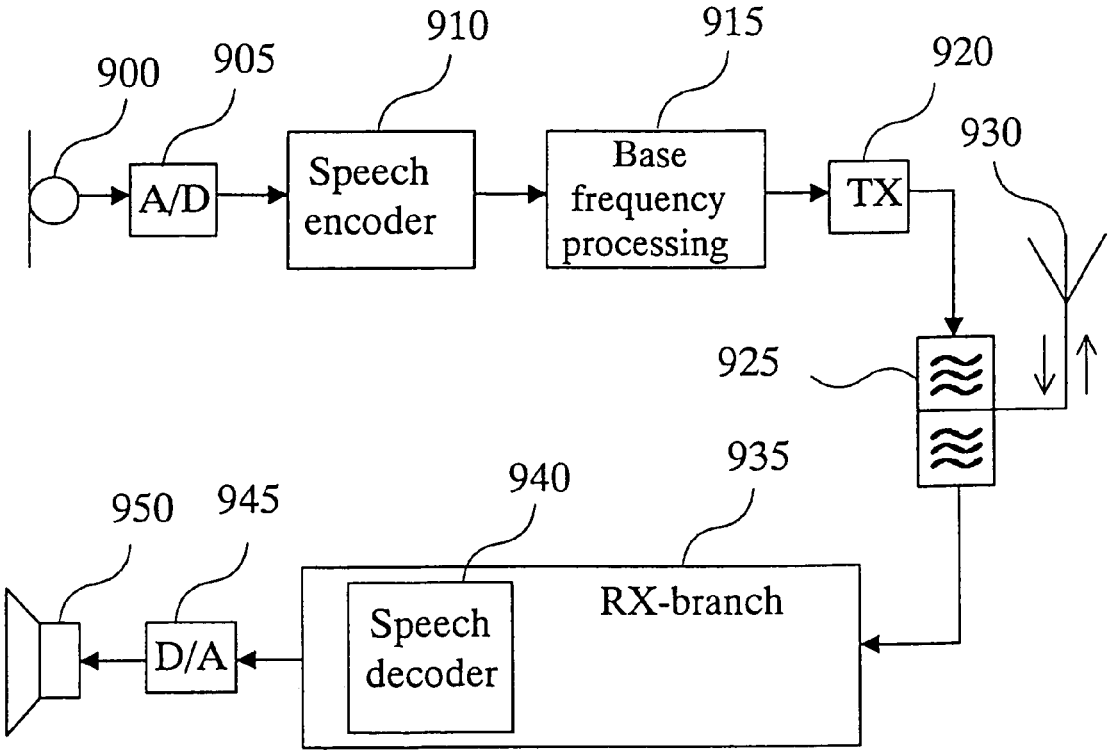
FIG. 9 depicts a basic functional block diagram of an exemplary mobile terminal incorporating the invented speech coder.

FIG. 9 depicts a basic functional block diagram of an exemplary mobile terminal incorporating the invented speech coder. In a transmission process, a speech signal uttered by a user is picked up with microphone 900 and sampled in A/D-converter 905.

The digitized speech signal is then encoded in speech encoder 910 in accordance with the embodiment of the invention. Processing of the base frequency signal is performed on the encoded signal to provide the appropriate channel coding in block 915. The channel coded signal is then converted to a radio frequency signal and transmitted from transmitter 920 through a duplex filter 925. The duplex filter 925 permits the use of antenna 930 for both the transmission and reception of radio signals. The received radio signals are processed by the receiving branch 935 where they are decoded by speech decoder 940 in accordance with the embodiment of the invention. The decoded speech signal is sent through a D/A-converter 945 for conversion to an analog signal prior to being sent to loudspeaker 950 for reproduction of the synthesized speech.

The present invention contemplates a technique to improve the coded speech quality in AbS coders without increasing the bit rate. This is accomplished by relaxing the waveform matching constraints for nonstationary (plosive) or unvoiced speech signals in locations where accurate pitch information is typically perceptually insignificant to the listener. It should be noted that the invention is not limited to the "peakiness" method described for detecting plosive speech and that any other suitable method can be used successfully. By way of example, techniques that measure the local signal qualities such as rate of change or energy can be used. Furthermore, techniques that use the standard deviation or correlation may also be employed to detect plosives.

Although the invention has been described in some respects with reference to a specified embodiment thereof, variations and modifications will become apparent to those skilled in the art. In particular, the inventive concept is not limited to speech signals but may be applied to music and other types of audible sounds, for example. It is therefore the intention that the following claims not be given a restrictive interpretation but should be viewed to encompass variations and modifications that are derived from the inventive subject matter disclosed.

The invention claimed is:

1. A method of encoding a speech signal, the method comprising:

obtaining in an encoder a pulse train using a first excitation codebook, wherein the pulse train includes a plurality of pulses located at a first set of locations in accordance with the first excitation codebook, the first excitation codebook having a first position grid;

shifting the pulse locations of a first set of locations in the encoder to obtain a second set of locations in accordance with a second excitation codebook, the second excitation codebook having a second position grid and the first position grid containing a higher population density of pulse positions than the second position grid; and producing a coded excitation signal.

2. A method according to claim 1 wherein the method is performed by a low bit rate Analysis-by-Synthesis (AbS) speech coder.

3. A method according to according to claim 1 wherein the method is applied to nonstationary speech segments of the speech signal.

4. A method according to any of the preceding claims wherein the population density of the first excitation codebook is approximately in a range of five to ten times the density as compared to that in the second excitation codebook.

5. A method according to according to claim 1 wherein the method is preferably applied to nonstationary speech segments of the speech signal which are determined by detecting the level of "peakiness" that is typically indicative of nonstationary speech.

6. A method according to any of the preceding claims wherein the "peakiness" value is used to calculate a dispersion value for subsequent phase randomization.

7. A method of transmitting a speech signal from a sender to a receiver comprising the steps of:

obtaining a pulse train using a first excitation codebook in an encoder, wherein the pulse train includes a plurality of pulses located at a first set of locations in accordance with the first excitation codebook, the first excitation codebook having a first position grid;

shifting the pulse locations of the fist set of locations in the encoder to obtain a second set of locations in accordance with a second excitation codebook, the second excitation codebook having a second position grid and the first position grid containing a higher population density of pulse positions than the second position grid;

producing a speech excitation signal in an encoder at the sender;

transmitting said encoded excitation signal to the receiver; and decoding said encoded excitation signal with a decoder to produce synthesized speech at the receiver.

8. A method according to claim 7 wherein the method is performed by a low bit rate Analysis-by-Synthesis (AbS) speech coder.

9. A method according to claim 7 wherein the method is applied to nonstationary speech segments of the speech signal.

10. A method according to claim 7 wherein the "peakiness" or dispersion information is transmitted from the encoder to the decoder for use in phase randomization of the decoded signal.

11. A method according to claims 7 wherein the population density of the first excitation codebook is approximately in a range of five to ten times the density as compared to that in the second excitation codebook.

12. A method according to claim 7 wherein the method is preferably applied to nonstationary speech segments of the speech signal which are determined by detecting a level of "peakiness" that is typically indicative of nonstationary speech.

13. A method according to claim 12 wherein the "peakiness" value is used to calculate a dispersion value for subsequent phase randomization of the decoded signal.

14. An encoder for encoding speech signals wherein the encoder comprises:

means for obtaining a pulse train using a first excitation codebook, wherein the pulse train comprises a plurality of pulses located at a first set of locations in accordance with the first excitation codebook, the first excitation codebook having a first position grid;

means for shifting pulse locations of the first set of locations to obtain a second set of locations in accordance with a second excitation codebook, the second excitation codebook having a second position grid and the first position grid containing a higher population density of pulse positions than the second position grid; and means for producing a speech excitation signal in an encoder at the sender.

15. An encoder according to claim 14 wherein the encoder is included within a low bit rate Analysis-by-Synthesis (AbS) speech coder.

16. An encoder according to claim 14 wherein the encoder includes means for detecting nonstationary segments in the speech signals.

17. An encoder according claim 14 wherein the encoder includes means for calculating a "peakiness" value of a segment of the speech signal.

18. An encoder according claim 17 wherein the encoder includes means for calculating a dispersion value for subsequent phase randomization from the "peakiness" value.

19. A device comprising a speech coder for encoding and decoding speech signals, wherein the device further comprises:

means for obtaining a pulse train using a first excitation codebook, wherein the pulse train includes a plurality of pulses located at a first set of locations in accordance with the first excitation codebook, the first excitation codebook having a first position grid;

means for shifting pulse locations of the first set of locations to obtain a second set of locations in accordance with a second excitation codebook, the second excitation codebook having a second position grid and the first position grid containing a higher population density of pulse positions than the second position grid; and means for producing a speech excitation signal in an encoder at the sender.

20. A device according to claim 19 wherein the device includes means for detecting nonstationary segments in the speech signals.

21. A device according to claim 19 wherein the device is a mobile terminal.

22. A device according to claim 19 wherein the device is a radio base station.

23. A device according to claim 19 wherein the device is a voice storage or voice messaging device.

* * * * *

UNITED STATES PATENT AND TRADEMARK OFFICE

CERTIFICATE OF CORRECTION

PATENT NO. : 7,089,180 B2
APPLICATION NO. : 10/167287
DATED : August 8, 2006
INVENTOR(S) : Ari P. Heikkinen It is certified that error appears in the above-identified patent and that said Letters Patent is hereby corrected as shown below:

In column 10, Claim 4, line 7, delete “any of the preceding claims” and replace with --claim 1--.

In column 10, Claim 5, line 15, delete “the” and replace with --a--.

In column 10, Claim 6, line 17, delete “any of the preceding claims” and replace with --claim 5--.

In column 10, Claim 7, line 27, delete “fist” and replace with --first--.

Signed and Sealed this

Twelfth Day of December, 2006

JON W. DUDAS
*Director of the United States Patent and Trademark Office*